US006488245B1

(12) United States Patent
Maglione

(10) Patent No.: US 6,488,245 B1
(45) **Date of Patent: *Dec. 3, 2002**

(54) DISPLAY STAND WITH RELEASABLE COLLAPSIBLE SUPPORT

(76) Inventor: Stephen Thomas Maglione, 71 Baltusrol Way, Far Hills, NJ (US) 07931

( * ) Notice: Subject to any disclaimer, the term of this patent is extended or adjusted under 35 U.S.C. 154(b) by 119 days.

This patent is subject to a terminal disclaimer.

(21) Appl. No.: 09/648,600

(22) Filed: Aug. 26, 2000

Related U.S. Application Data

(63) Continuation-in-part of application No. 09/236,527, filed on Jan. 25, 1999, now Pat. No. 6,234,433.

(51) Int. Cl.[7] ..... A45D 19/04
(52) U.S. Cl. ..... 248/174; 248/152; 248/135
(58) Field of Search ..... 248/174, 459, 248/166, 152, 465; 211/149, 72, 73

(56) References Cited

U.S. PATENT DOCUMENTS

| | | | | | |
|---|---|---|---|---|---|
| 3,237,901 | A | * | 3/1966 | Guyer, Jr. et al. | 248/174 |
| 3,433,365 | A | | 3/1969 | Hodson | 211/59 |
| 3,738,604 | A | * | 6/1973 | Howlett et al. | 248/459 |
| 3,836,104 | A | * | 9/1974 | Miller et al. | 248/174 |
| 3,871,608 | A | | 3/1975 | Ogden | 248/223 |
| 4,253,777 | A | * | 3/1981 | Pillifant, Jr. | 248/150 |
| 4,671,417 | A | | 6/1987 | O'Brien | 211/59.1 |
| RE32,668 | E | * | 5/1988 | Smith | 211/149 |
| 4,773,173 | A | * | 9/1988 | Christian | 248/174 |
| 5,522,574 | A | * | 6/1996 | Maglione | 248/174 |
| 5,542,551 | A | * | 8/1996 | Smith | 248/174 |
| 5,558,921 | A | * | 9/1996 | Pavlik | 248/174 |
| 5,620,104 | A | | 4/1997 | Maglione | 211/59.1 |
| 5,630,518 | A | * | 5/1997 | Collins | 211/132.1 |
| 5,762,207 | A | * | 6/1998 | Maglione | 211/59.1 |
| 5,826,732 | A | * | 10/1998 | Ragsdale | 211/149 |
| 5,868,367 | A | * | 2/1999 | Smith | 248/174 |
| 6,126,254 | A | * | 10/2000 | Maglione | 312/259 |
| 6,234,433 | B1 | * | 5/2001 | Maglione | 248/174 |

* cited by examiner

*Primary Examiner*—Anita King
*Assistant Examiner*—Steven M. Marsh
(74) *Attorney, Agent, or Firm*—William Squire

(57) ABSTRACT

A point of sale display stand includes a peg type article display tray having side walls, an end wall forming shelf and a bottom wall which is inclined upright when in use. A tray support has a collapsible state and a deployed state. The support comprises two triangular sidewalls with medial foldlines and spaced upper and lower rear walls connected by foldlines to the sidewalls. A flat sheet material brace is attached to the lowermost support rear wall medially the upper and rear walls by a foldline. The support has two sets of two L-shaped tabs that mate in slots in the tray bottom wall. The bottom wall cooperates with the support three walls to form a four wall support for the tray. The tabs have cantilevered legs wherein an upper pair of tabs have their cantilevered legs facing upwardly and the lower pair of tabs have their cantilevered legs facing in the opposite direction downwardly when the display is in use. The lower tabs cantilevered portions fold over so the tabs can be inserted in relatively smaller slots in the tray to securely lock these tabs in place which unfold after insertion into the slots.

18 Claims, 12 Drawing Sheets

DISPLAY STAND WITH RELEASABLE COLLAPSIBLE SUPPORT

This application is a continuation in part of application Ser. No. 09/236,527 filed Jan. 25, 1999 now U.S. Pat. No. 6,234,433.

This invention relates to article display stands comprising display trays for use with collapsible tray supports.

Of interest are commonly owned U.S. Pat. Nos. 5,762,207 and 5,620,104 incorporated by reference herein.

Display stands employing corrugated paperboard are in wide use. The stands have numerous configurations established for particular point of sale display of articles. Generally, such stands have a display portion and a support for retaining the display portion upright or inclined in a display orientation. See for example the aforementioned U.S. patents. Stands may have shelves or they may have a display panel from which pegs extend for hanging articles for display. For example, see the aforementioned patents and U.S. Pat. Nos. 3,871,608, 4,671,417 and 3,433,365 for peg type displays all incorporated by reference herein.

These displays are counter type units which are relatively small, light and easy to assemble. Other displays are floor mounted and typically have large boxes and the like for supporting a display member. Many are collapsible type displays and require, in some cases, relatively complex assembly of the various components. Because they are generally paperboard, the interconnections of the components tend to be difficult at times and sometimes the connections may become damaged during assembly affecting the connection of the various components. Typically such displays need to be first assembled prior to placement into use at the point of sale location. This can be time consuming for the personnel involved and is not always conducive to proper assembly and thus can lead to an unattractive display.

The present inventor recognizes a need for a point of sale display that can be readily assembled quickly and without possible damage to the interrelated connections. In particular, a need is recognized for a display support that is readily adaptable to conventional displays but needs no mechanical assembly of the components. The support can be readily deployed from a portable configuration to a display configuration with no or a minimum of such component assembly.

A collapsible display stand according to the present invention comprises an article display tray for receiving articles to be displayed; the tray having a bottom wall, a pair of opposing side walls and an end wall forming a display chamber, the bottom wall having spaced slots adjacent to the opposing side walls, the tray further including a front wall spaced from and juxtaposed with the bottom wall, the end wall being coupled to the bottom wall and front wall forming a shelf in the tray chamber.

A collapsible display tray support is included and has a deployed state and a collapsed state, the support including at least one rear wall with opposing first edges, opposing spaced first and second side walls each hinged to the rear wall at a different one of the rear wall opposing first edges, the first and second side walls each having a medial first hinge and a second edge distal the first hinge and distal the at least one rear wall such that the first and second side walls can each selectively collapse against the at least one rear wall.

At least one tab extends from each of the first and second side walls at the second edge thereof the at least one tab being received in a different slot in the tray to releasably secure the support to the tray whereby in the collapsed state the at least one rear wall and the first and second side walls are juxtaposed with at least a portion of the tray bottom wall and in the extended state the tray serves to stiffen the support such that the tray and support cooperate to form a self supporting display stand.

In one embodiment, the support first and second side walls, tabs, at least one rear wall and brace are one piece paperboard and the tray is one piece paperboard.

In a further embodiment, the at least one rear wall comprises two spaced coplanar rear walls and further includes a brace, the brace being secured to one of the two rear walls medially the two rear walls, the brace in the collapsed state being positioned between and coplanar with the two spaced rear walls, the brace, rear walls, first and second side walls and tabs being one piece paper board.

In a further embodiment, the tray side walls, bottom wall and front wall each have a support edge, the support first and second side walls and at least one rear wall each having a further edge that is coplanar with the tray support edges, all the edges lying in and defining a support plane for the tray and support.

Preferably the at least one rear wall comprises two spaced rear walls and a brace member hinged to a first of the rear walls for abutting the tray bottom wall in the extended deployed state.

In a further embodiment, the tabs are hook-shaped. Preferably the tabs are L-shaped, the support rear and side walls each having coplanar edges forming a support edge, the tabs comprising two sets of two tabs in each set, the hooks of each set facing in opposite directions. Also, preferably the slots in the tray have a given length, a first tab of each set being proximal to the support edge, the tabs each having first and second legs, the first leg extending from a corresponding support side wall edge and the second leg extending cantilevered from the first leg parallel to the corresponding side wall edge, the first leg having a transverse width in the direction of the cantilevered second leg, the transverse width being approximately the same value as the length of the mating slot in the tray bottom wall such that the cantilevered second leg must be folded juxtaposed with the first leg for insertion into the mating slot.

IN THE DRAWING

Figure 1:
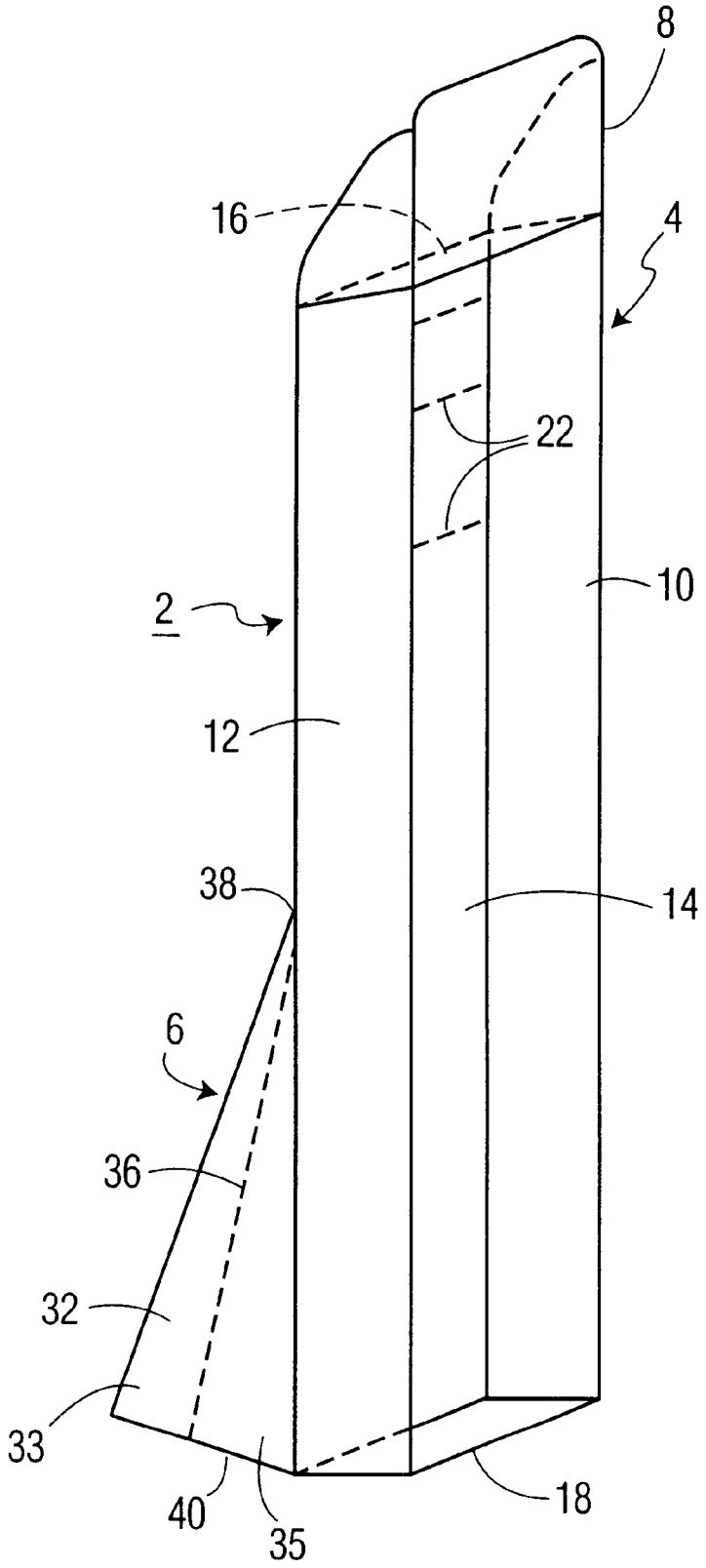
FIG. 1 is an isometric frontal view of a display stand according to an embodiment of the present invention.
Figure 6A:
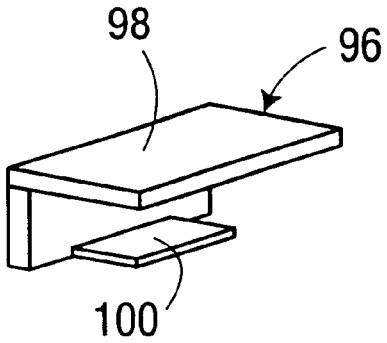
FIG. 6 is a fragmented isometric view of the collapsed support portion of the stand of the present invention.
Figure 6B:
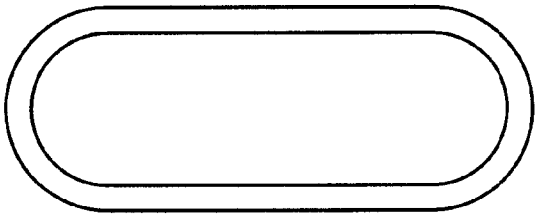
Figure 6:
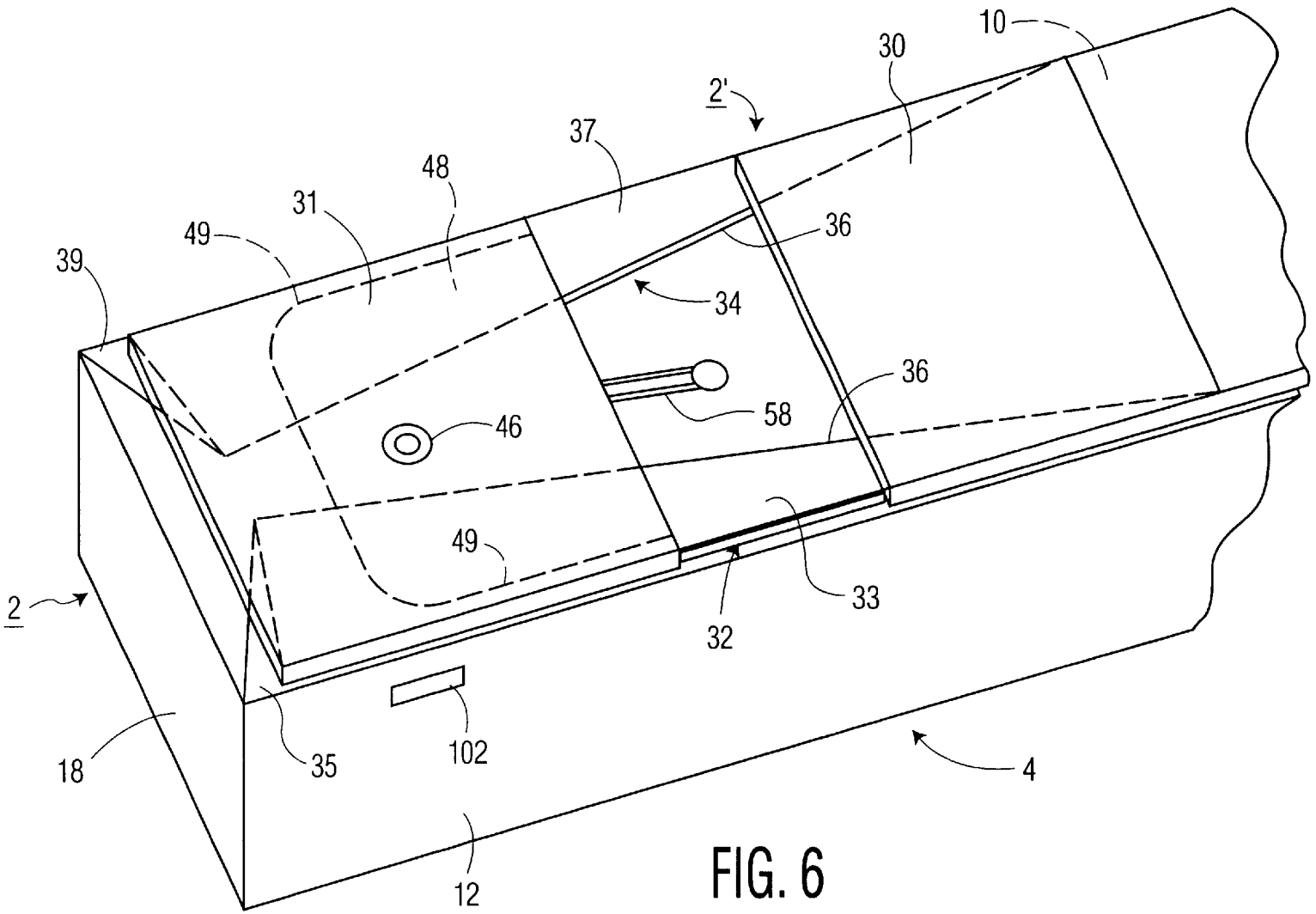
Figure 7:
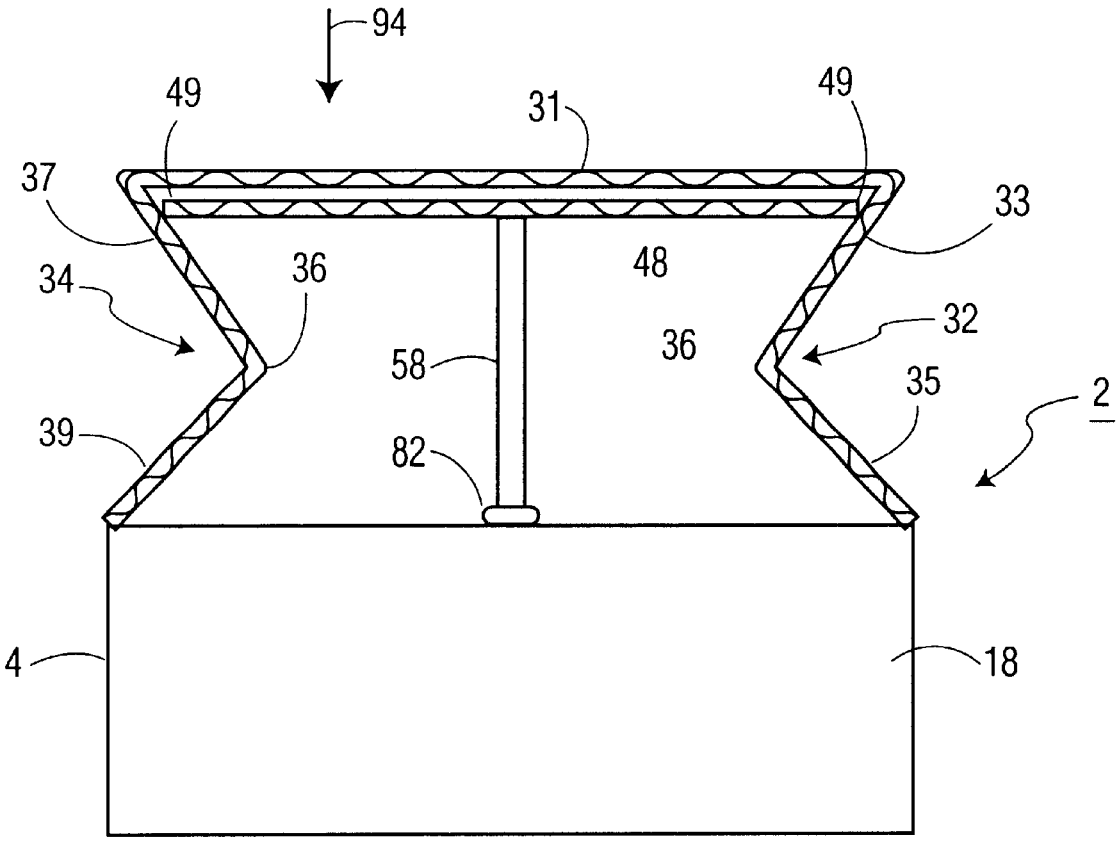
Figure 8:
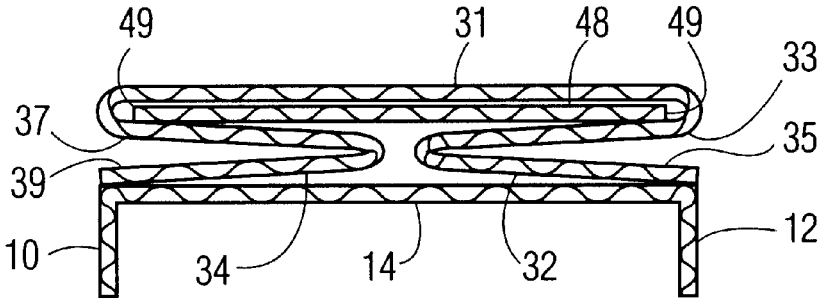
Figure 9:
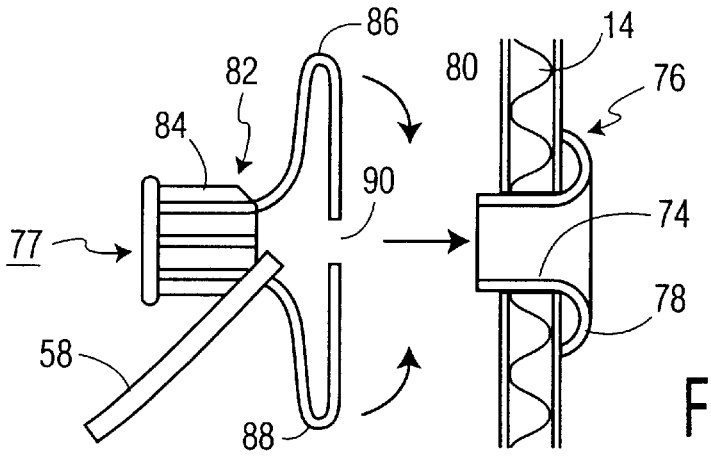
Figure 10:
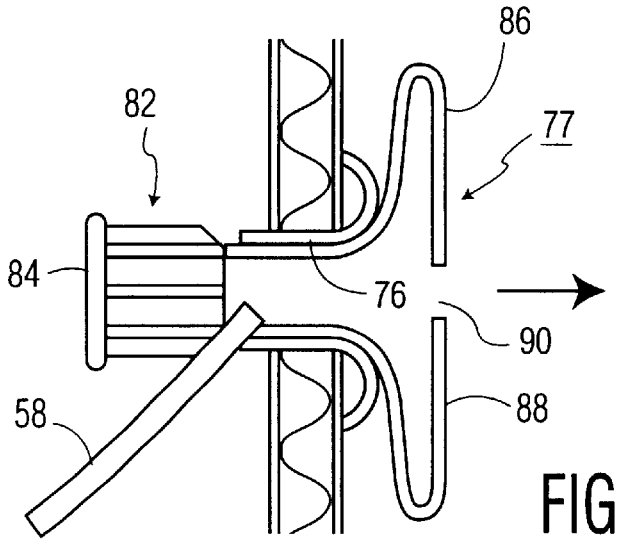
Figure 11:
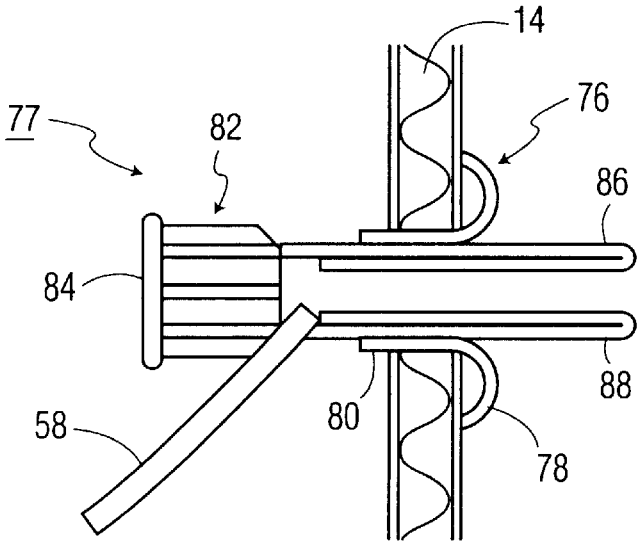
Figure 12:
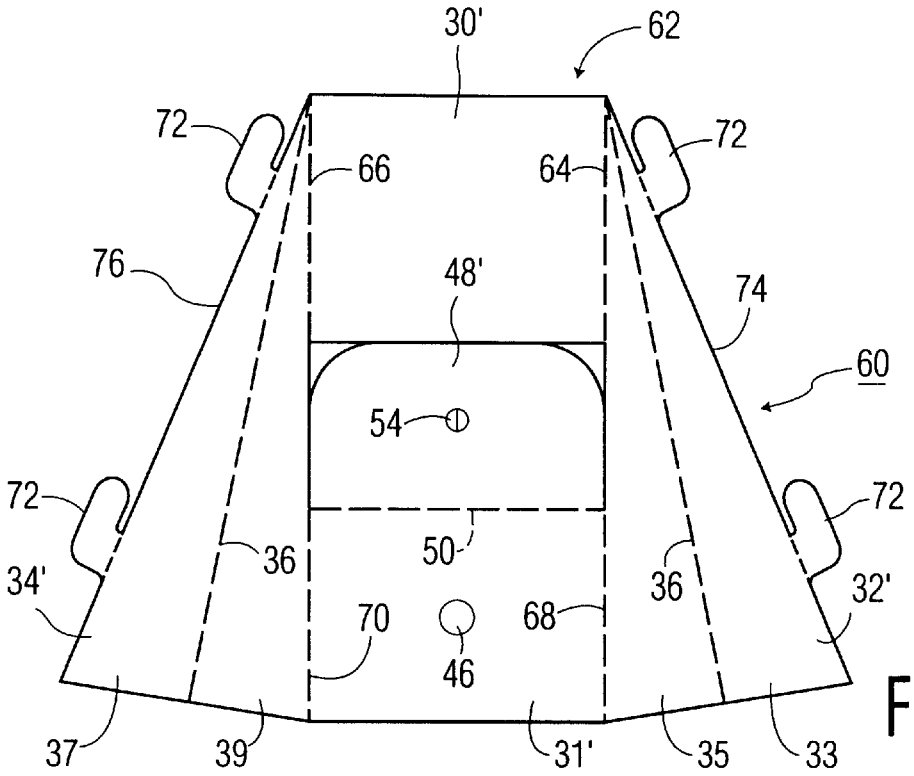
Figure 13:
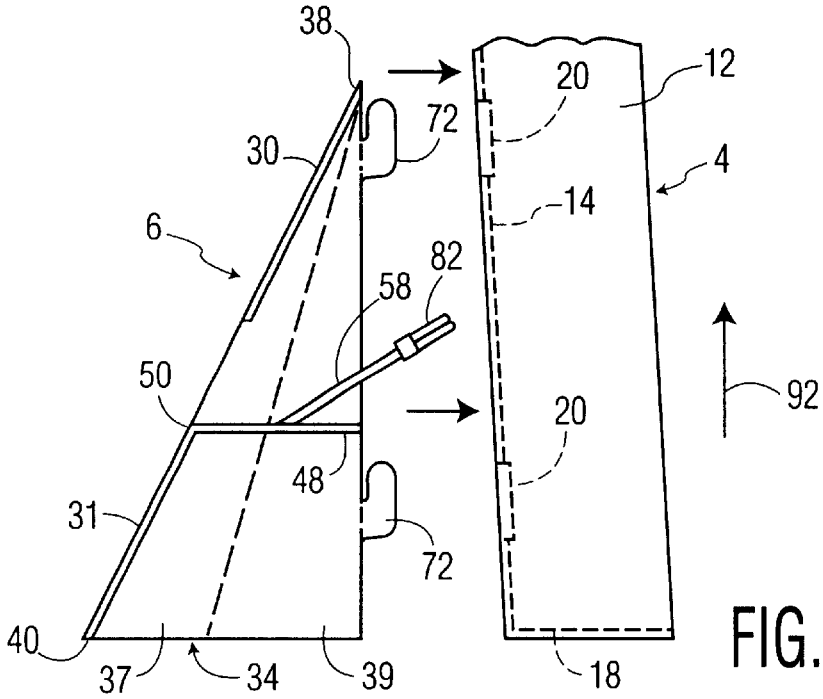
Figure 14:
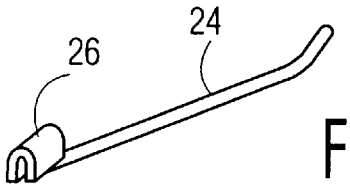

FIG. 6*a* is an isometric view of a clip which may be used to hold the collapsed portion of FIG. 6 collapsed;

FIG. 6*b* is an elevation view of an elastic band which in the alternative may be used to hold the collapsed portion of FIG. 6 collapsed;

FIG. 7 is an end view of the display of the present invention showing partial deployment of the support;

FIG. 8 is an end sectional view of the display of the present invention showing the collapsed state of the support;

FIGS. 9–11 are elevation sectional views showing various stages of assembling an elastic support biasing member to the display;

FIG. 12 is a top plan view of a blank forming the support of the display stand of FIG. 1;

FIG. 13 is an exploded side elevation view of the stand of FIG. 1 during assembling of the support to the display portion of the stand; and FIG. 14 is an isometric view of a representative peg hook for use in the display of FIG. 1.

Figure 15:
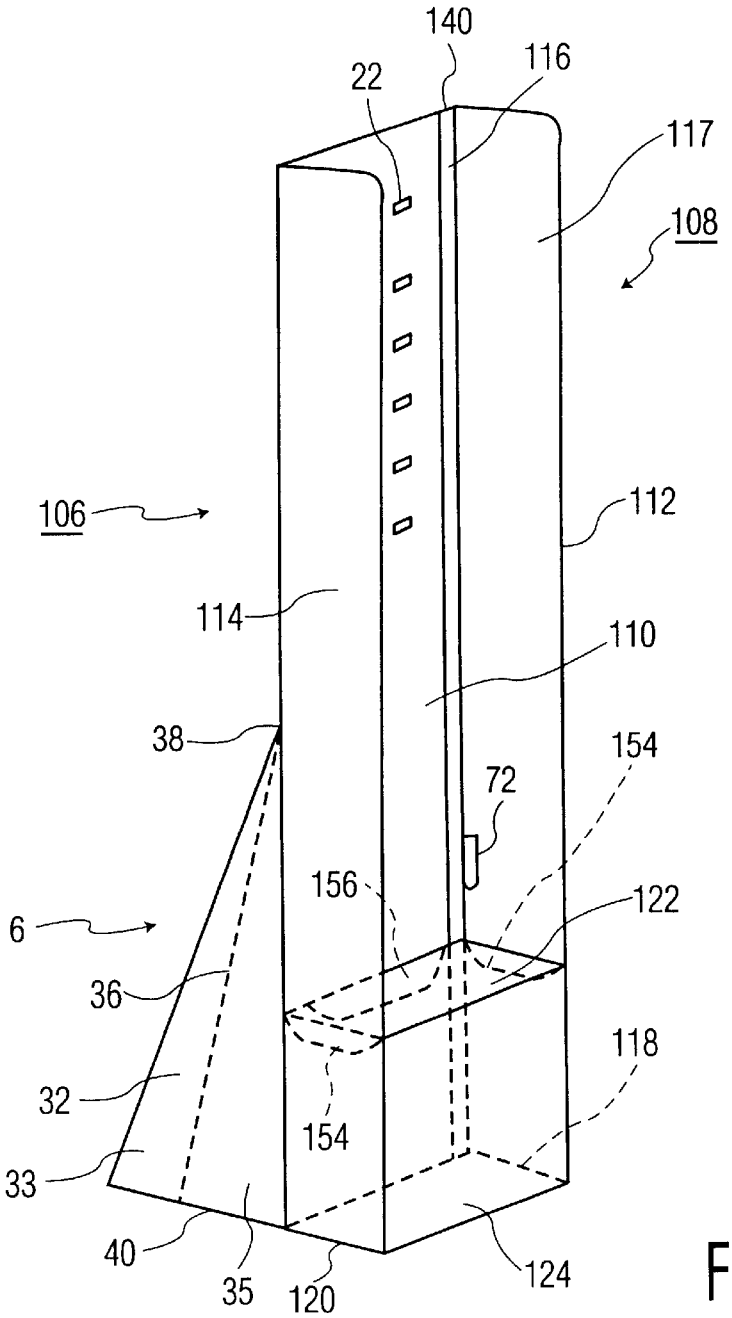
Figure 15A:
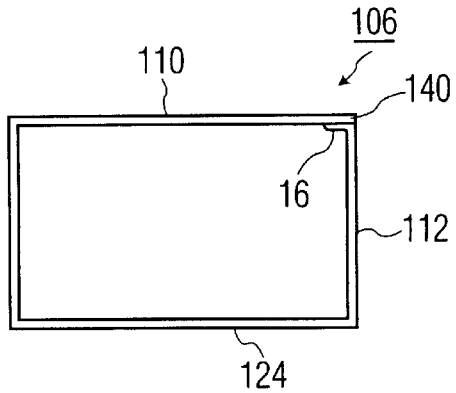
Figure 15B:
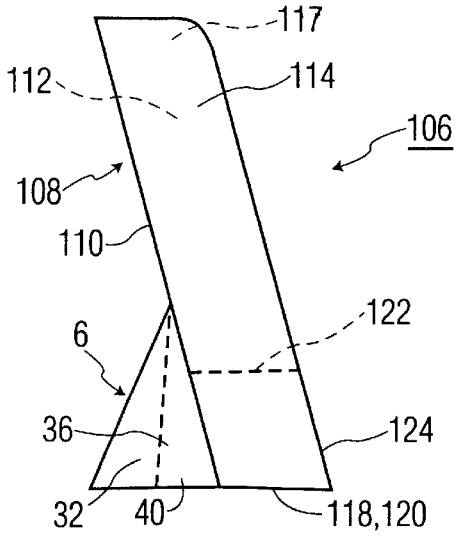
Figure 16:
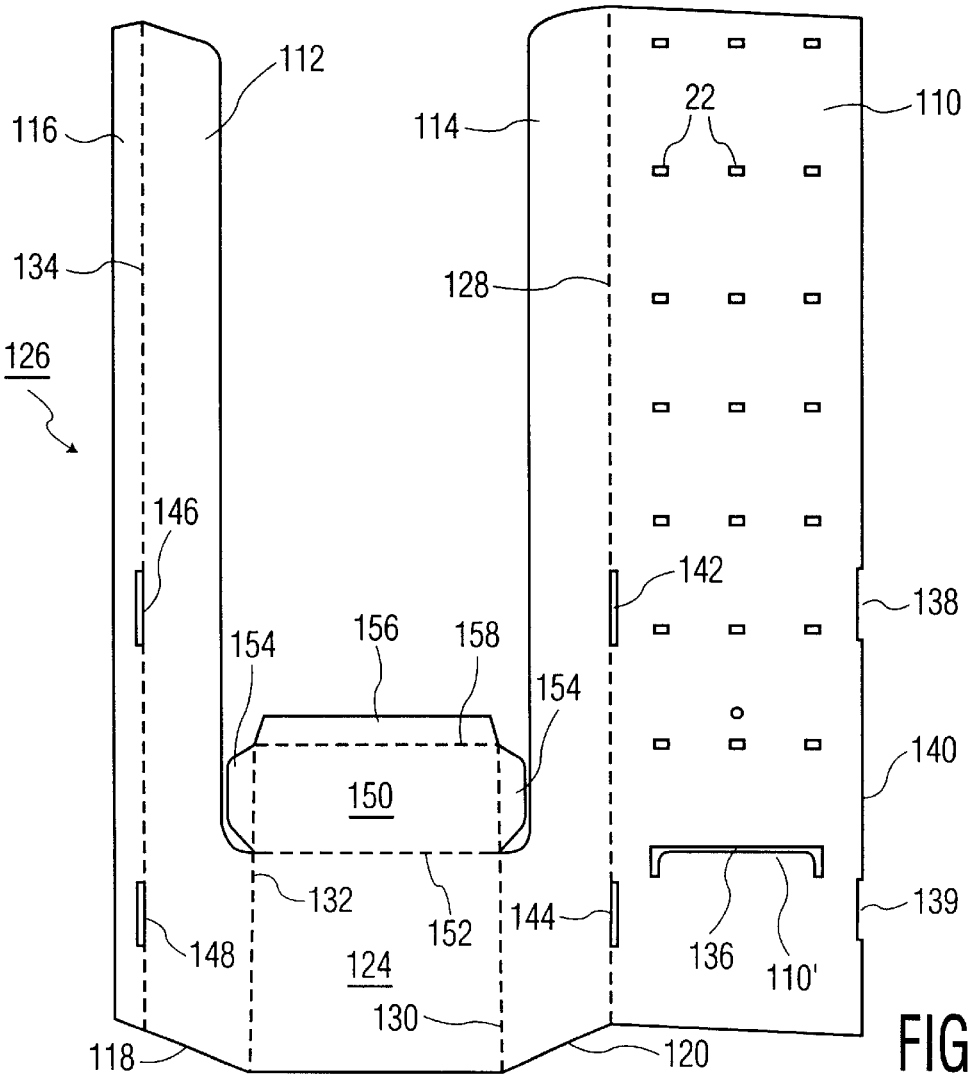
Figure 17:
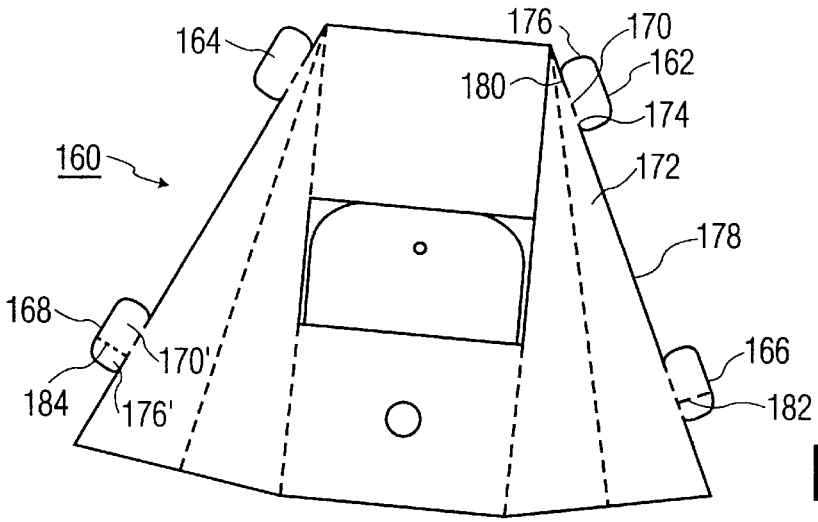
Figure 18:
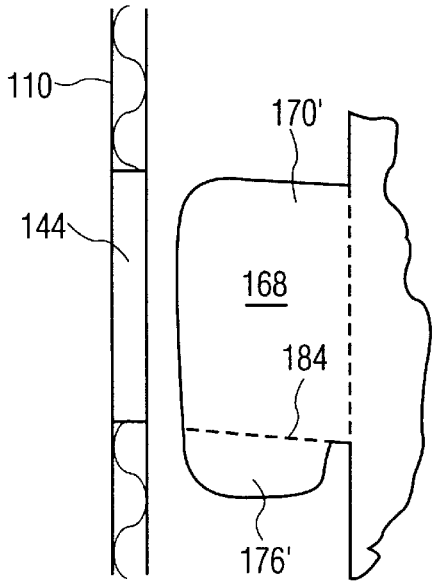
Figure 19:
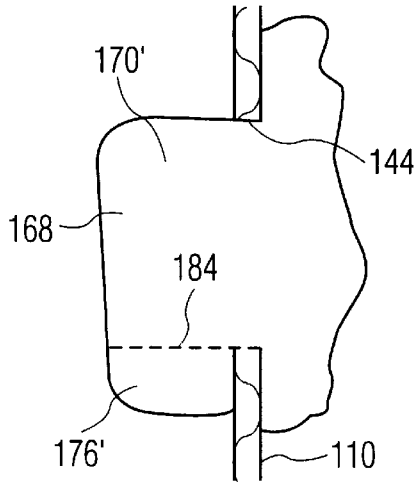

FIG. 15 is an isometric view of a display according to a second embodiment of the present invention;

FIG. 15*a* is a sectional top plan view of the bottom portion of the display of FIG. 15;

FIG. 15*b* is a side elevation view of the display of FIG. 15;

FIG. 16 is a plan view of the paperboard blank used to form the tray of FIG. 15;

FIG. 17 is a plan view of the blank used to form the support of FIG. 15;

FIG. 18 is a fragmented side elevation sectional exploded view of the connection of a lower tab and matings slot in the tray; and FIG. 19 is a view similar to that in FIG. 18 with the tab assembled to the slot.

In FIGS. 1–4, display stand 2 comprises a display 4 and a collapsible deployable support 6. A decorative cap 8 is secured on the top of the display 4. The display 4, support 6 and cap 8 are all preferably formed of sheet single ply corrugated paperboard. Other materials such as pressed paperboard, cardboard or non-paper materials may be used according to a given implementation.

Display 4 comprises a single one piece sheet of paperboard that is folded at fold lines to form mirror image sidewalls 10 and 12, rear display wall 14 and mirror image respective top and bottom walls 16 and 18. The sidewalls 10 and 12 and top and bottom walls 16 and 18 are formed by folding over the sheet material to form a double layer of sheet material. The side, top and bottom walls include conventional tabs (not shown) engaged with slots 20 in the rear wall at the rear wall edges for locking the walls normal to the rear wall in conventional fashion. The end walls are formed with tabs (not shown) that engage slots formed by the doubled over sidewalls. The display 4 thus takes the shape of an elongated box with an open front. In the alternative, the display may comprise a planar wall with no top, bottom or sidewalls.

The rear wall 14 is formed with a plurality of slots 22 for receiving a peg 24, FIG. 14. Peg 24 has a hook 26 at one end for engaging the rear wall 14 at a slot 22. Similar peg type arrangements are disclosed in the aforementioned patents incorporated by reference herein.

The cap 8 is a single ply of paperboard folded at fold lines and attached to slots in the top of the display 4 at slots such as slots 20 with tabs 28. The cap is not essential and does not form a part of the present invention.

The collapsible support 6 comprises a single ply of sheet corrugated paperboard and has an upper rear wall 30 and a lower rear wall 31 spaced from the upper rear wall. The support includes two triangular sidewalls 32 and 34. A fold line 36 forming a hinge is in each sidewall 32 and 34 extending from each sidewall apex 38 to a support edge 40 at the bottom of the support 6. The fold lines are shown as dashed lines. The sidewalls 32 and 34 are respectively, folded to the rear walls 30 and 31 at fold lines 42, 42' and 44, 44' which form hinges between the sidewalls and the support rear walls 30 and 31. The sidewalls are normal to the rear walls 30 and 31. All of the walls are generally flat.

Figure 5:
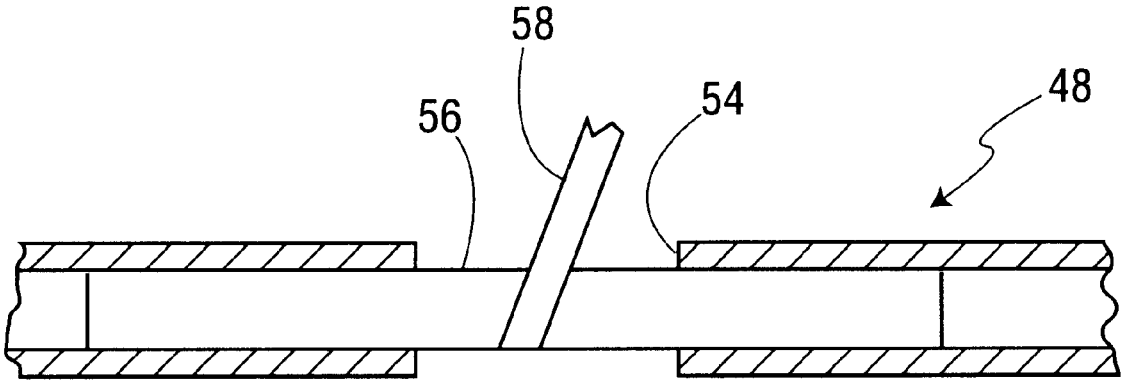
FIG. 5 is a more detailed sectional view of the region 5 in FIG. 4.

A circular hole 46 is in lower rear wall 31. A brace 48 is integral and one piece with the support rear wall 31 at fold line 50 forming a hinge for the brace. The brace 48 comprises a flat rectangular in plan view sheet member with rounded comers 52. As best seen in FIG. 5, the brace 48 has a circular hole 54 and a flute pin 56 which spans the hole 54 and is located within the flutes of the corrugated sheet forming the brace 48. An elastic band 58 is secured to the pin 56 in hole 54. The pin 56 and hole 54 are generally centrally located in the brace 48.

In FIG. 12, a blank 60 forms the support 6. The blank 60 has a rectangular center section 62 formed with sections 30' and 31' which form the rear walls 30 and 31, respectively. Section 48' forms the brace 48 and is connected to section 31' by fold line 50. Triangular sections 32' and 34' form sidewalls 32 and 34 respectively. Section 30' is connected to section 32' by fold line 64 and to section 34' by fold line 66. Section 32' is connected to section 31' by foldline 68 and section 34' is connected to section 31' by foldline 70. Hook shaped tabs 72 extend from the edges 74 and 76 of respective sections 32' and 34'. The sections correspond to the same elements of the support 6 with the same reference numerals but without the primes. The tabs 72 are inserted into and lock to the display 4 via slots 20' in the display, FIG. 2.

The foldlines 36 in the sidewalls 32 and 34 divide the sidewalls into triangular sections. Wall 32 is divided into sections 33 and 35 and wall 34 is divided into sections 37 and 39, FIGS. 2 and 4. With the tabs 72 so inserted the sidewalls 32 and 34 of the support 6 are coextensive with the sidewalls 12 and 10, respectively, of the display 4.

In FIG. 9, display 4 rear wall 14 has a hole 74. A connection assembly 77 connects the band 58 to the display 4 rear wall 14. The assembly 77 includes a conventional circular metal grommet 76 that has a flange 78 and a shank 80. The shank 80 is inserted into the wall 14 hole 74 and extends beyond the rear of the rear wall 14. The assembly 77 also includes a wing connector 82 which has a fluted head 84 and a pair of wings 86, 88 interconnected as a single loop. A slit 90 separates the wings 86 and 88. Without the slit 90, the connector 82 is conventional. The slit 90 permits the elastic band 58 to be inserted inside the loop of the wings 86 and 88 as shown. The slit 90 is optional.

In FIG. 11, the wings 86 and 88 are bent together and inserted through the hollow core of the grommet shank 80. The wings are inserted completely through the grommet until they can be spread apart to the original condition of FIG. 9, FIG. 10. This locks the assembly 77 to the wall 14 and the other end of the band 58 distal the brace 48, FIG. 4, to the display 4 rear wall 14.

Figure 2:
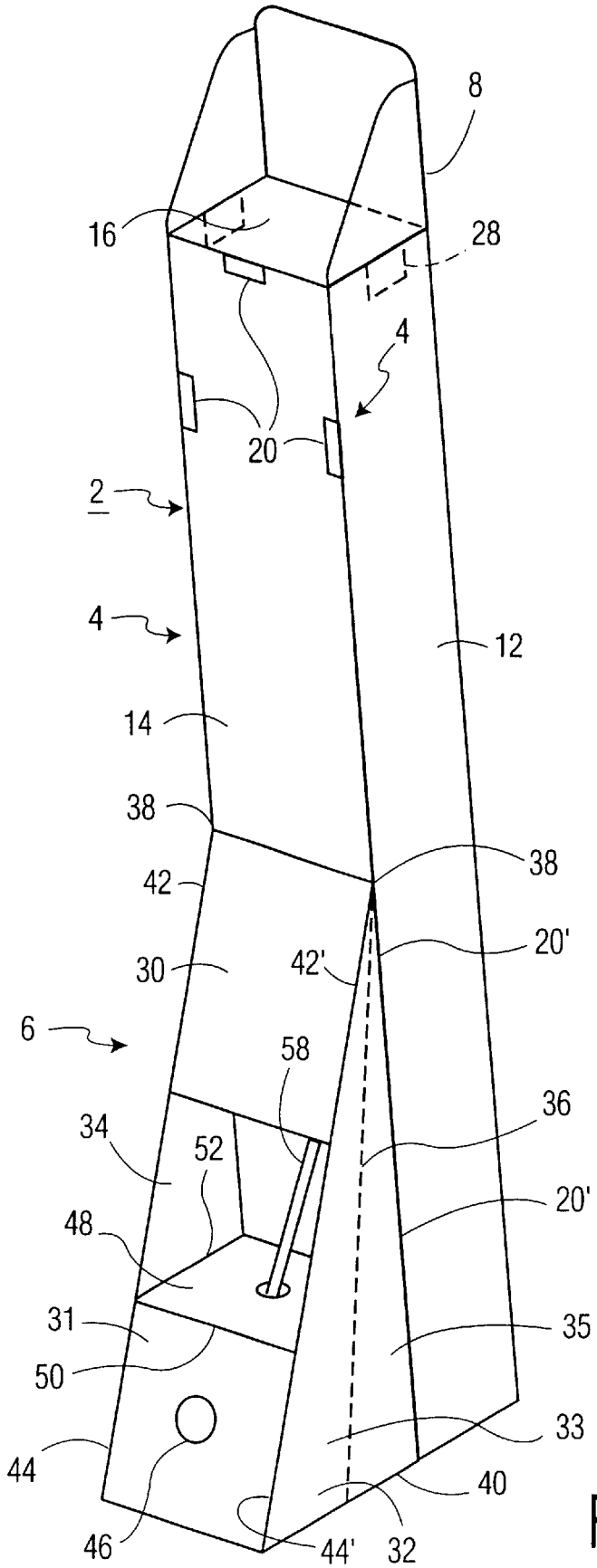
FIG. 2 is an isometric rear view of a display stand of the embodiment of FIG. 1.
Figure 3:
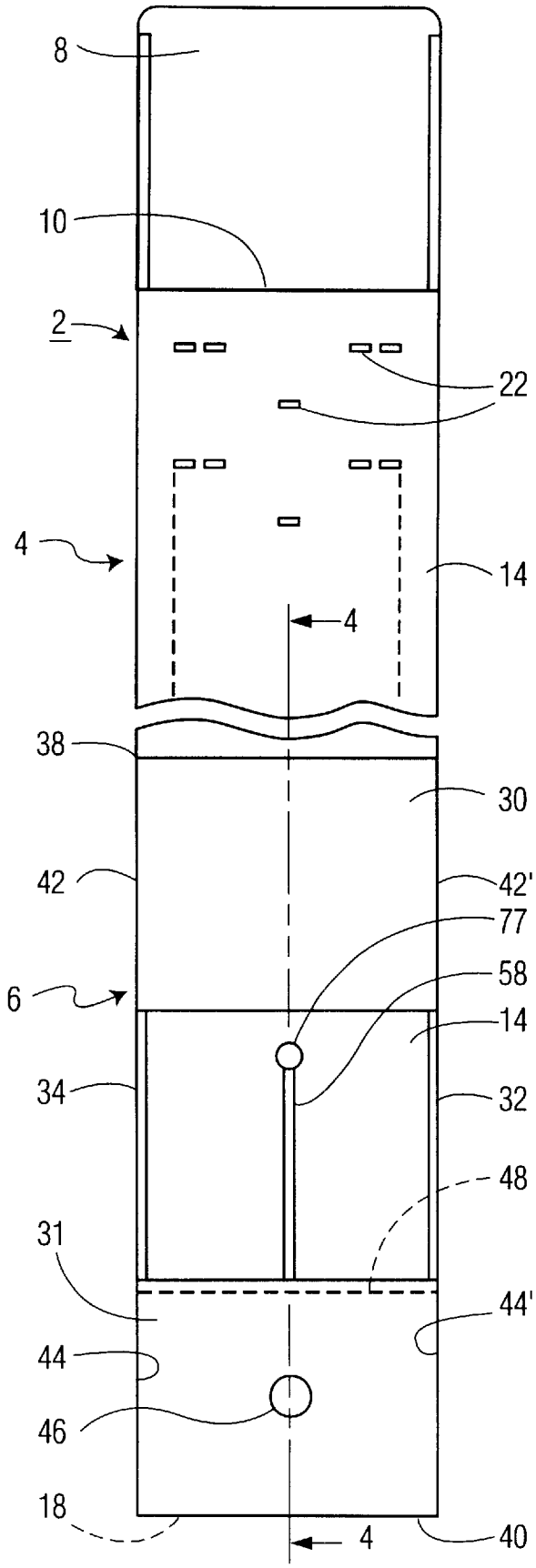
FIG. 3 is a rear elevation view of the stand of FIG. 1.

In FIG. 13, the support 6 is opened to the deployed state shown with the brace 48 folded over at foldline 50 parallel to the edge 40. The tabs 72 are inserted into the slots 20 in the display 4. The support 6 is then displaced upwardly direction 92 to lock it to the display 4. The assembly looks as shown in FIGS. 1–3.

Figure 4:
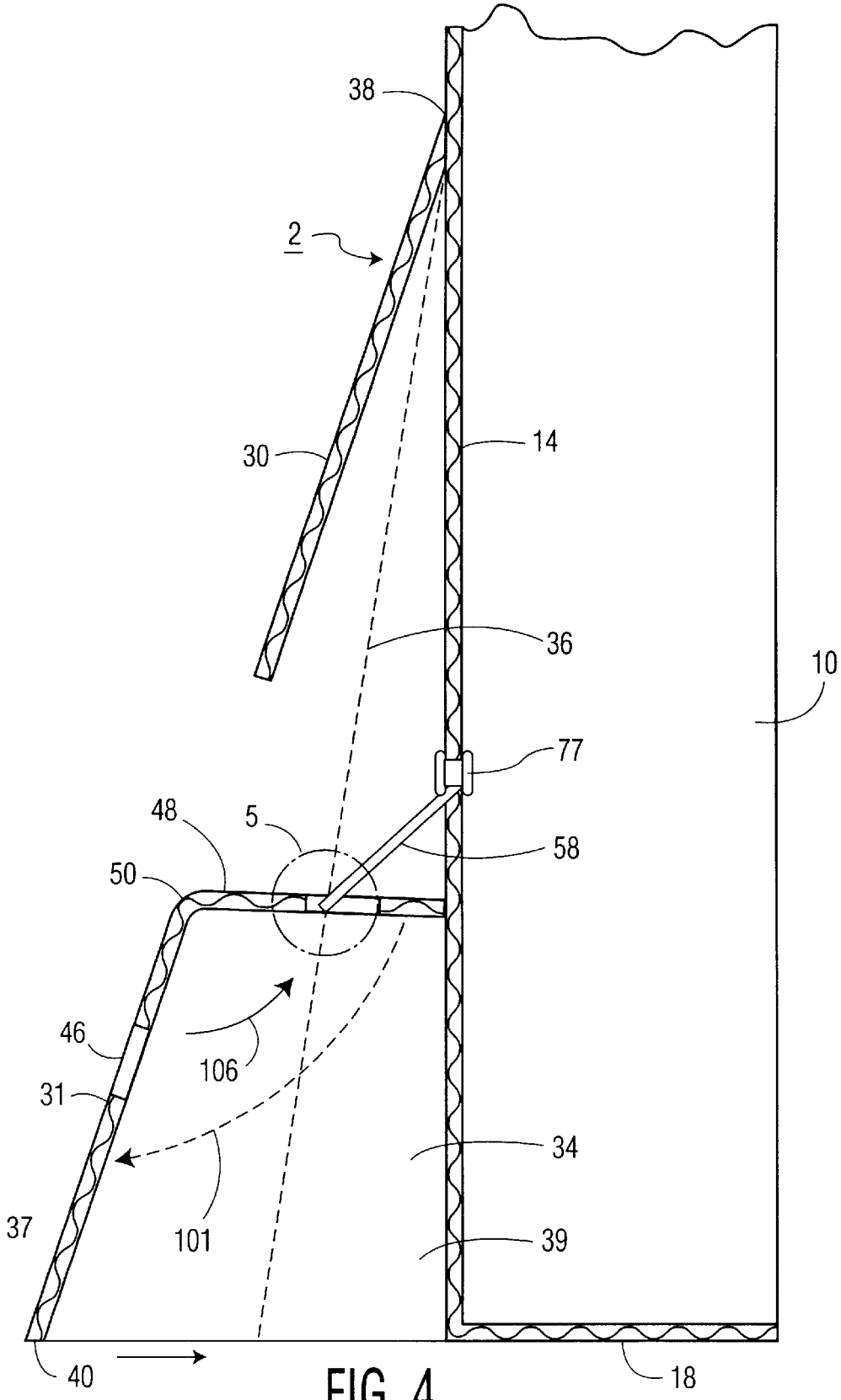
FIG. 4 is a sectional elevation view of the embodiment of FIG. 3 taken along lines 4—4.

In operation, to collapse the support 6, FIG. 7, the brace 48 is first folded under and overlying the rear wall 31, direction 101, FIG. 4. The brace may or may not abut the wall 31. This requires stretching the elastic band 58. Then the rear wall 31 is pushed toward the display 4 rear wall 14 in direction 94, FIG. 7. This folds the sidewalk 32 and 34 at foldlines 36 inwardly toward each other. The rear wall 31 is pushed further until the support 6 walls are collapsed as shown in FIGS. 6 and 8. In this state, the walls of the support 6 are either abutting or in closely spaced overlying relation. The location of the band 58 on the brace 48 and on the display 4 rear wall 14 and its length are such that the band in its stretched condition in the collapsed state can not open the support to its fully deployed state of FIG. 1. The force of the band 58 may tend to open the support from the collapsed state slightly. There is insufficient force, however, to fully deploy the support to its deployed support condition of FIG. 1 due to the relative angle of the tensile force on the member 58 imposed on the brace 48. This deployment requires a snap action.

To keep the collapsed support fully collapsed, a clip 96 may be used. The clip has a flange 98 and a tab 100. The flange 98 overlies the collapsed rear wall 31, FIG. 6, with the tab 100 inserted in side slot 102. A clip 96 is on each side of the display 4. In the alternative, an elastic band 104, FIG. 6*b,* may be used to wrap about the collapsed assembly to keep the support 6 fully collapsed. A cord (not shown) or other arrangements, in the alternative, may be used to retain the support fully collapsed. Although no retainer is essential to keep the support 6 collapsed, such a retainer is useful to preclude accidental deployment of the support.

To deploy the support 6 from the collapsed state, the rear wall 31 is merely manually lifted in a direction away from the display rear wall 14, opposite direction 94, FIG. 7. A point is reached at which the position of the brace is such and the force of the elastic band 58 is sufficient to automatically snap rotate the brace 48 direction 106, FIG. 4, from its folded collapsed state of FIG. 6 to the open deployed state of FIGS. 1–3.

The brace 48 automatically snaps into the position of FIG. 4 and stops in place as a function of the bias force on the;band 58 once the wall 31 is displaced past a certain position. The brace 48 in the deployed state abuts the side walls 32 and 34 on each opposing brace edge 49, locking the side walls extended. Only when the brace is manually folded back to the brace collapsed state of FIG. 7, are the side walls now freed to fully collapse. With the brace deployed as in FIG. 4, the side walls can not fold inwardly toward each other into the collapsed state.

A stop (not shown) on the display 4 rear wall 14 may be used in the alternative to stop the brace at the locked position of FIG. 4. Thus no manual assembly of interlocking pieces as in the prior art displays is required. The tension in the member 58 creates potential energy sufficient to cause the collapsed support 6 to automatically assume the deployed state. This deployment occurs automatically with a mere finger lifting action on the rear wall 31.

In FIGS. 15 and 15*b,* display stand 106 comprises a display tray 108 releaseably attached to and supported by support 6. Like reference numerals refer to like parts throughout the drawings. The tray 108 has bottom wall 110, and two opposing side walls 112 and 114. Side wall 112 has a flap 116 hinged to side wall 112 and glued to bottom wall 110. The bottom wall 110 and side walls 112 and 114 form a display chamber 117. The side walls 112 and 114 have bottom edges 118, 120 respectively which are coplanar with edge 40 of the support 6 to form a common support plane with the support 6.

The tray 108 has an end wall 122 which forms a bottom shelf of the display chamber 117. The tray 108 has a front wall 124. The side wall 114 is hinged to the bottom wall 110 by a fold line and the front wall is hinged to the side walls 112 and 114 by respective fold lines.

In FIG. 16, the blank 126, which is single ply corrugated paperboard, forms the tray 108. The blank 126 comprises bottom wall 110 with display hanger slots 22. Side wall 114 is hinged at fold line 128 to wall 110. Front wall 124 is hinged to side wall 114 by fold line 130 and to side wall 112 by fold line 132. Flap 116 is hinged at fold line 134 to side wall 112. Fold lines are shown by dashed lines and through cuts are shown by solid lines.

A U-shaped slot 136 is formed in the bottom portion of the rear wall 110. Two rectangular shallow recesses 138 and 139 are formed in the edge 140 of rear wall 110. Recess 138 is longer than recess 139. Two elongated rectangular slots 142 and 144 are in the rear wall adjacent to fold line 128. The slots 142, 144 and recesses 138, 139 are respectively aligned from left to right in the drawing figure. The recess 138 and slot 142 are the same length and the recess 139 and slot 144 are the same length but shorter than the recess 138 and slot 142. Two elongated rectangular slots 146 and 148 are in the flap 116 at fold line 134. The slot 146 is aligned with slot 142 from left to right in the figure and is the same length as slot 142. The slot 148 is aligned with slot 144 from left to right in the figure and is the same length as slot 144.

A panel 150 is hinged to front wall 124 at fold line 152. Panel 150 forms shelf 122, FIG. 15. Two flaps 154 are hinged to panel 150 by respective fold lines. A third flap 156 is hinged to panel 150 by fold line 158.

To assemble the blank 126, the flap 116 is folded over so it overlies the rear wall 110 at edge 140 as shown in FIG. 15. The flap 116 is glued in place to wall 110. The recesses 138 and 139 over lie the slots 146, 148, respectively to form two slots adjacent to edge 140. The remaining walls are folded over at their fold lines to form a cross section as shown in FIG. 15*a.* The slots 142, 144, 146 and 148 are in the rear wall 110 adjacent to their respective fold lines as shown.

The panel 150 is bent over at fold line 152 so it is normal to the front wall 124. The flap 156 is bent over at its fold line 158 and is inserted into the slot 136. The rear wall 110 portion 110' serves as a support for the panel 150 and the resulting shelf 112 (FIG. 15). The flaps 154 are folded over and are juxtaposed with the side walls 112 and 114. The tabs 72 of the support 6 (FIG. 12) are inserted into the slots 142, 144, 146 and 148 to attach the support 6 to the tray 108.

In the alternative to support 6, a second embodiment of a support is shown by blank 160. Blank 160 is identical to blank 60 FIG. 12 except for tabs 162, 164, 166 and 168. Tabs 162 and 164 are identical and tabs 166 and 168 are identical. Representative tab 162 has a first leg 170 attached to side wall 172 by fold line 174. A second leg 176 extends cantilevered from the first leg 170 and is spaced from the side wall 172 edge 178 by a small slot 180.

The tabs 166 and 168 are substantially the same in construction as tabs 162 and 164 except for fold lines 182 and 184. The fold lines 182 and 184 are at the junction of the legs 170' and 176' of representative tab 168. In FIG. 18, the tab 168 is aligned with the slot 144 which has a length the same as the leg 170' width in a direction from the top of the figure to the bottom of the figure. To insert the tab 168 through the slot 144, the leg 176' is folded over at fold line 184 to overlie a portion of leg 170' forming a sandwich configuration. The sandwiched tab is then inserted through the slot 144. When the leg 176' is released, it has resiliency at its fold line 184, and tends to unfold, partially or fully as in FIG. 19. When unfolded, leg 176' forms a lock preventing the tab 168 from being withdrawn through the slot 144. Both of the tabs 116 and 168 are inserted in this manner.

The slots 142 and 146 are longer than slots 144 and 148 and receive the entire tab of tabs 162, 164 therethrough without folding over the cantilevered portions as in tab 168. However the alignment of the tabs 162 and 164 to their respective slots 142 and 146 is such that these tabs must be inserted first prior to insertion of the tabs 166 and 168. After insertion, the tabs 162 and 164 and the rest of the support formed by blank 160 are displaced upwardly in the figure toward the top of the drawing, FIG. 15. When so displaced, the tabs 166 and 168 then become aligned with their respective slots 148 and 144. This displacement places the cantilevered legs 176 misaligned with and beyond the mating slots locking these tabs to the tray to preclude withdrawal through the slots.

Since the lower tabs 166 and 168 are now aligned with their respective mating slots, the cantilevered portions are folded over as described above and inserted through the respective slots. The unfolding of the cantilevered legs 176' of the lower tabs locks these tabs in place to the tray and thus secure the support formed by blank 60 to the tray.

Removal of the support requires the reverse process wherein the lowermost tabs are withdrawn from the slots first and then the upper tabs removed in reverse order of the attachment process of above.

As seen in FIG. 15*b,* the edges 118, 120 and 40 and the lower edge of the rear wall 110 of the tray 106 are coplanar and form a support plane for the support 6 and tray 106. The tray 106 is sometimes referred to as a power wing in this art. Power wing trays of the prior art do not extend to the floor as does the tray 108, FIG. 15*b,* or tray 4, FIG. 1. Trays of the prior art typically are mounted on support bases which require separate assembly and which are more costly than the three walled support 6 of the present invention. In this case the tray rear wall serves both as a tray display wall and as rigidifying member for the support and which cooperates with the support to form a self supporting support stand. No glue is required to attach the tray to the support which can be attached preassembled by the factory. The user merely deploys the support 6 to form a display stand ready for use without complex unfolding procedures and without the use of gluing of additional flaps to form the support.

It will occur to one of ordinary skill that various modifications may be made to the disclosed embodiments which are given by way of illustration and not limitation. For example triangular sidewalls of the support are not necessary. They may be other shapes such as rectangular, curved and so on. Also, while two side wails, a rear wall and a brace are disclosed, other arrangements of biased walls may be provided to support a display that has a collapsed state and an extended deployed state. The tabs while L-shaped, may be other shapes, e.g., curved or angular for example. Also, the tabs may be formed by a detent arrangement wherein the tabs snap fit in place by providing a variable thickness to the tabs with a groove therein for receiving the mating wall of the attached member. It is intended that the scope of the invention is as defined by the appended claims.

What is claimed is:

1. A collapsible display stand comprising:

an article display tray for receiving articles to be displayed; the tray having a bottom wall, a pair of opposing side walls and an end wall forming an article display chamber having an open front region arranged to permit an article to be placed into the chamber and visible therethrough, the bottom wall having spaced slots adjacent to the opposing side walls, the tray further including a front wall spaced from and juxtaposed with the bottom wall, the end wall being coupled to the bottom wall and front wall forming a shelf in the tray chamber;

a collapsible display tray support having a deployed state and a collapsed state, the support including at least one rear wall with opposing first edges, opposing spaced first and second side walls each hinged to the rear wall at a different one of the rear wall opposing first edges, the first and second side walls each having a medial first hinge and a second edge distal the first hinge and distal the at least one rear wall such that the first and second side walls can each selectively collapse against the at least one rear wall; and at least one tab extending from each of the first and second side walls at the second edge thereof, the at least one tab being received in a different slot in the tray to releasably secure the support to the tray whereby in the collapsed state the at least one rear wall and the first and second side walls are juxtaposed with at least a portion of the tray bottom wall and in the extended state the tray serves to stiffen the support such that the tray and support cooperate to form a self supporting display stand.

2. The stand of claim 1 including a brace for the at least one rear wall wherein the support first and second side walls, tabs, at least one rear wall and brace are one piece paperboard and the tray is one piece paperboard.

3. The stand of claim 1 wherein the at least one rear wall comprises two spaced coplanar rear walls and further including a brace, the brace being secured to one of the two rear walls medially the two rear walls, the brace in the collapsed state being positioned between and coplanar with the two spaced rear walls, the brace, rear walls, first and second side walls and tabs being one piece paper board.

4. The stand of claim 1 wherein the tray side walls, bottom wall and front wall each have a support edge, the support first and second side walls and at least one rear wall each having a further edge that is coplanar with the tray support edges, all said edges lying in and defining a support plane for the tray and support.

5. The stand of claim 1 wherein the at least one rear wall comprises two spaced rear walls and a brace member hinged to a first of said rear walls for abutting the tray bottom wall in the extended deployed state.

6. The stand of claim 1 wherein the tabs are hook-shaped.

7. The stand of claim 6 wherein the tabs are L-shaped, the support rear and side walls each having coplanar edges forming a support edge, the tabs comprising two sets of two tabs each set, the hooks of each set facing in opposite directions.

8. The stand of claim 7 wherein the slots in the tray have a given length, a first tab of each set being proximal to said support edge, the tabs each having first and second legs, the first leg extending from a corresponding support side wall edge and the second leg extending cantilevered from the first leg parallel to the corresponding side wall edge, the first leg having a transverse width in the direction of the cantilevered second leg, the transverse width being approximately the same value as the length of the mating slot in the tray bottom wall such that the cantilevered second leg must be folded juxtaposed with the first leg for insertion into said mating slot.

9. The stand of claim 7 wherein at least a portion of the tabs have a portion thereof that are required to be folded over for insertion into the mating slot of the tray and natural resiliency of the tab portion at the fold line returns the tab portion to an unfolded position for locking the tab to the mating slot.

10. The stand of claim 7 wherein the front, side, end and bottom walls of the tray form a cavity, the tabs being arranged so that a set of first tabs are in the cavity, the first set of tabs having cantilevered portions extending in a direction away from the shelf, and a second set of tabs being in the display chamber external the cavity, the second set of tabs having cantilevered portions extending in a direction away from the shelf in a direction opposite the cantilevered direction of the first set of tabs.

11. The display stand of claim 1 wherein the support walls have edges that define a support plane, the support extending from the support plane a first given length, the tray having a length greater than that of the support first given length, the tray having a first end approximately coextensive with the support plane and a second end distal the first end extending beyond the support.

12. A collapsible display stand comprising:

an article display tray for receiving articles to be displayed; the tray having a bottom wall, a pair of opposing side walls and an end wall extending from the bottom wall, the tray having spaced slots in the bottom wall adjacent to the opposing side walls;

a collapsible display member support having at least one rear wall with opposing first edges, opposing spaced first and second side walls each hinged to the rear wall at a different one of the rear wall opposing first edges, the first and second side walls each having a second edge distal the first hinge and distal the at least one rear wall such that the first and second side walls can each selectively collapse against the at least one rear wall; and at least one tab extending from each of the first and second side walls at the second edge thereof, the at least one tab being received in a different slot in the tray to releasably secure the support to the tray whereby in the collapsed state the at least one rear wall and first and second side walls are juxtaposed with at least a portion of the tray rear wall and in the extended state the tray bottom wall cooperates with the support to form a four wall support structure with the support thereby forming a self supporting display stand, said bottom wall and said opposing side walls forming an article display chamber having an open front region arranged to permit articles to be placed into the chamber and visible therethrough.

13. The stand of claim 12 further including a medial hinge between the first and second edges.

14. The stand of claim 13 wherein the medial hinge is located to form each side wall into first and second side wall sections.

15. The stand of claim 14 wherein the sections are triangular.

16. The stand of claim 13 further including a brace having a collapsed state and and a deployed state, the brace being hinged to the at least one rear wall and shaped and sized to abut the opposing first and second support side walls and tray bottom wall in the deployed state to stiffen the deployed side walls, the medial hinge forming each of the first and second side walls into first and second sections, the collapsed sections of the first and second side walls each folding relative to each other at the respective medial hinge, the collapsed sections of a side wall and the brace being juxtaposed with the at least one rear wall and tray bottom wall in the collapsed state.

17. A collapsible display stand comprising:

an article display tray for receiving articles to be displayed; the tray having a bottom wall, a pair of opposing side walls and an end wall forming an article display chamber having an open front region arranged to permit an article to be placed into the chamber and visible therethrough, the bottom wall having spaced slots adjacent to the opposing side walls, the tray further including a front wall spaced from and juxtaposed with the bottom wall, the end wall being coupled to the bottom wall and front wall forming a shelf in the tray chamber;

a collapsible display tray support having a deployed state and a collapsed state, the support including at least one rear wall with opposing first edges, opposing spaced first and second side walls each hinged to the rear wall at a different one of the rear wall opposing first edges such that the first and second side walls can each selectively collapse juxtaposed with the at least one rear wall, the side walls each having a second edge distal the rear wall first edges; and at least one tab extending from each of the first and second side walls at the second edge thereof, the at least one tab being received in a different slot in the tray to releasably secure the support to the tray whereby in the collapsed state the at least one rear wall and the first and second side walls are juxtaposed with at least a portion of the tray bottom wall and in the extended state the tray serves to stiffen the support such that the tray and support cooperate to form a self supporting display stand.

18. The collapsible display stand of claim 17 wherein the first and second side walls each have a medial first hinge forming first and second sections in the side walls, the sections of each side wall and hinges being arranged so that the sections are juxtaposed with each other and with the rear wall in the collapsed state.

* * * * *